United States Patent [19]

Nezworski

[11] 4,350,270

[45] Sep. 21, 1982

[54] PORTABLE KEG TAPPING COUPLER WITH VENT

[75] Inventor: James E. Nezworski, Waukesha, Wis.

[73] Assignee: The Perlick Company, Inc., Milwaukee, Wis.

[21] Appl. No.: 201,245

[22] Filed: Oct. 27, 1980

[51] Int. Cl.[3] ..... B67D 5/42

[52] U.S. Cl. ..... 222/336; 222/400.7

[58] Field of Search ..... 222/400.7, 321, 340, 222/384, 385, 399, 373, 397, 341, 383, 336

[56] References Cited

U.S. PATENT DOCUMENTS

| | | | |
|---|---|---|---|
| 912,603 | 2/1909 | Nestor | 222/397 X |
| 2,529,645 | 11/1950 | Winks et al. | 222/397 |
| 3,837,541 | 9/1974 | Grigsby | 222/397 |
| 4,196,828 | 4/1980 | Basile et al. | 222/340 |

*Primary Examiner*—Stanley H. Tollberg

*Attorney, Agent, or Firm*—James R. Custin; James E. Nilles

[57] ABSTRACT

A portable keg tapping unit, cooperable with a valved keg closure, has an outer body member which makes a bayonet connection with the closure and an inner body member with a lower portion that is rotatably and axially slidably received in the outer body member, an upper portion that comprises a pump chamber, and an intermediate portion above the outer body member. In the inner body member are a liquid passage that opens to its bottom and to a nipple at one side of its intermediate portion and a gas passage that extends down from the pump chamber and opens to its bottom in laterally spaced relation to the liquid passage. A vent passage, communicated with the gas passage below a check valve therein, has an outlet at another side of said intermediate portion, which outlet is normally blocked by a push button valve. A brief opening of the push button valve relieves excess keg pressure to prevent dispensing of wild beer.

4 Claims, 2 Drawing Figures

PORTABLE KEG TAPPING COUPLER WITH VENT

FIELD OF THE INVENTION

This invention relates to a portable coupler or tapping unit for valved kegs, which coupler is particularly suitable for occasional use, as at picnics or parties; and the invention is more particularly concerned with a portable coupler or tapping unit that comprises a hand pump for keg pressurization and has simple means for relieving excess pressure in a keg to which the unit is coupled.

RELATED APPLICATION

The subject matter of this application is closely related to that of the copending application of J. E. Nezworski and J. N. Strobel, Ser. No. 163,782, filed June 27, 1980, which has a common assignee herewith.

BACKGROUND OF THE INVENTION

In the widely used keg tapping systems of the type to which the present invention generally relates, each keg is fitted with a keg unit that is seated in its bung hole and comprises normally closed valves thaat are opened by installation on the keg of a coupler or tapping unit. The keg installation defines an upwardly opening well in which the coupler or tapping unit is receivable, and the bottom of the well is defined by an annular gas valve seat, a concentric annular gas valve which is biased upwardly for engagement with the gas valve seat and which itself defines a liquid valve seat, and a central poppet-like liquid valve that is biased upwardly for engagement with the liquid valve seat. When the keg is tapped, beer flows up to the liquid valve through a siphon tube which extends down to near the bottom of the keg, being forced up the siphon tube by pressure gas filled into the keg past the open gas valve.

A coupler or tapping unit to be coupled to the keg conventionally has a substantially annular outer body member that is received in the well and makes a bayonet connection with lugs on the keg that project radially into the well near its top. When that bayonet connection is established, a radially inner body member of the coupler is moved down to open the gas and liquid valves in the keg and thus communicate the interior of the keg with gas and liquid passages in the coupler.

In a tavern installation, the liquid passage in the coupler is more or less permanently connected with a duct that leads to a beer tap at the bar, while the gas passage in the coupler is connected with a source of pressure gas (usually a bottle of compressed carbon dioxide) from which the interior of the keg is pressurized.

When keg beer is purchased for consumption at a party or picnic, it is delivered in a keg having a valve installation identical to the one in a keg delivered to a tavern, but it is obviously impractical to provide a bottle of pressure gas, along with the plumbing and pressure control valves that are normally incorporated in the pressure gas system of a tavern installation. For such occasions, therefore, the keg is tapped by means of a portable tapping unit in which there is incorporated a hand pump that can be used for pressurizing the keg.

Most prior portable tapping couplers were basically tavern units that had been modified by the addition of a hand pump, but the above identified copending application discloses a portable tapping unit that is substantially less expensive and substantially more compact than a modified tavern unit and has other desirable features, including an easily operated hand pump.

The present invention is especially suitable for the portable tapping unit of said copending application, but it also lends itself to portable couplers of other types. The problem that it solves is one that has heretofore been common to all types of portable tapping units.

When a keg of beer is to be tapped, the interior of the keg is almost invariably under some gas pressure. Such pressure develops during filling of the keg and is increased by any subsequent rise in the temperature of the keg contents. When the keg is coupled to a tavern system, this so-called racking-off pressure is of no consequence because the duct that leads from the keg to the tap is refrigerated and the beer thus arrives at the tap outlet at a temperature and under a pressure no higher than it had in the keg. With a portable coupler, however, the beer flows out through an unrefrigerated duct, and if the pressure in the keg is too high, the gas in the beer will come out of solution as it flows to the tap. The result is the heretofore common and annoying experience that the first few glasses of beer drawn from a keg tapped at a party or picnic are "wild"—that is, almost entirely foam. After the outlet duct cools with flow of beer through it and keg pressure is reduced by withdrawal of beer, the beer appears to settle and is dispensed with no more than a desirable head of foam. Thereafter it is necessary to give the hand pump a few strokes from time to time, to maintain enough pressure in the keg for steady dispensing of beer. An excessive use of the hand pump at any time will again result in several glasses of wild beer being drawn. However, the hand pump in the coupling unit of said copending application is so arranged as to offer noticeably high resistance to operation when the keg is adequately pressurized, thus discouraging such pressurization as would cause wild beer to be dispensed.

SUMMARY OF THE INVENTION

The general object of the present invention is to provide a portable keg tapping coupler of the character described that is equipped with means for readily relieving excessive pressure in a keg to which the coupler is connected and which thus makes it possible to avoid the drawing of wild beer upon initial tapping of the keg and at any time thereafter that the keg may be too highly pressurized, as due to excessive operation of the hand pump.

It is also an object of the invention to provide, in a portable keg tapping coupler, a simple, inexpensive and easily operated means for preventing the drawing of wild beer, comprising a push button actuator that is readily accessible to be actuated for relief of excessive keg pressure when necessary, but which is not likely to be actuated inadvertently and offers no interference to operation of the hand pump, dispensing of beer, or installation or removal of the coupling unit.

These objects of the invention are achieved in a portable keg tapping unit comprising an outer body member that is readily disconnectably securable in an upwardly opening well in a valved keg closure unit and an inner body member that is movable concentrically up and down relative to the outer body member, to and from a lowered position in which the inner body member holds concentric gas and liquid valves in a keg closure unit off of their seats to permit pressure gas to enter the keg and liquid to flow out of it. The inner body member has a lower portion coaxially received in the outer body member and an upper portion projecting above the outer body member and comprising a manually actuatable pump. The inner body member has a gas passage therein that extends down to its bottom from the pump. The keg tapping unit of the pressure invention is characterized by a vent passage in the inner body member that opens from the gas passage to an outlet that is above the outer body member and is preferably at one side of the inner body member, below the pump; and by a vent valve in the inner body member which is biased to a closed position normally blocking flow of gas through the vent passage to said outlet and which comprises an actuator accessible above the outer body member for manual opening of said vent valve to relieve excess pressure in a keg to which the tapping unit is attached. Preferably the vent passage has a reduced diameter outer end portion defining an inwardly facing annular valve seat, and the vent valve comprises a push button actuator slideable in said outer end portion of the passage and having an enlarged diameter axially inner valve portion that comprises a valve element normally engaged with said valve seat.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
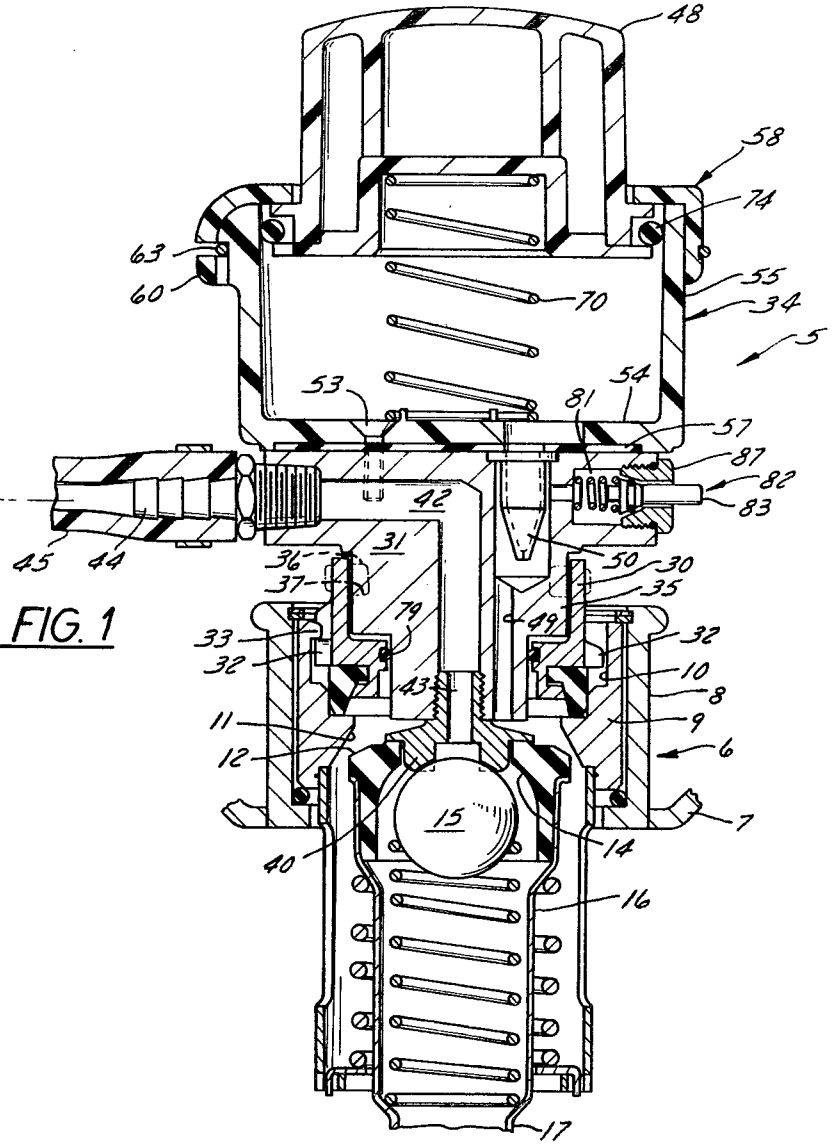
FIG. 1 is a view in vertical section of a portable keg tapping coupler embodying the present invention, shown installed on a valved keg closure and in its condition that provides for pressurizing the keg and drawing beer from it.
Figure 2:
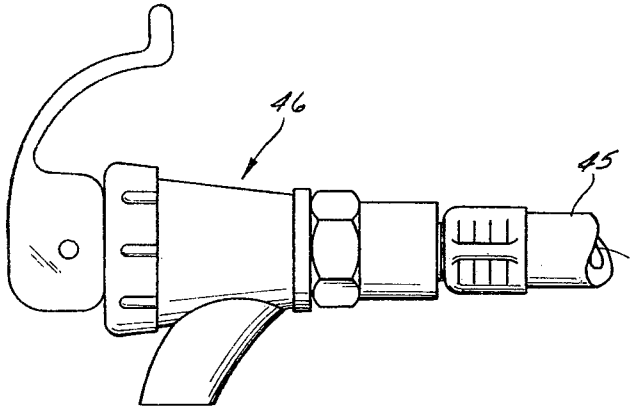
FIG. 2 is a detail view in vertical section, on a larger scale, particularly illustrating the vent valve for relieving excess keg pressure.
Figure 2:
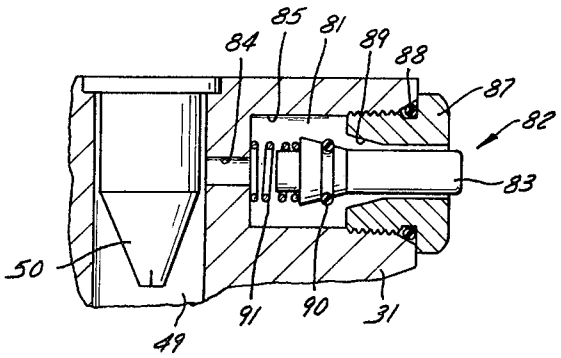

In the accompanying drawings, the numeral 5 designates generally a portable keg tapping unit or picnic coupler embodying the principles of this invention, intended for cooperation with a valved keg closure unit 6 of a conventional type, installed in a keg 7.

The keg 7 is made with a cylindrical neck 8 which constitutes its bung hole and in which a body portion 9 of the keg closure unit 6 is received. In its cooperation with the keg neck 8, the body 9 of the keg unit 6 defines an upwardly opening well 10, the bottom of which is in part defined by an annular gas valve seat 11. An annular gas valve 12, biased upwardly for engagement with the gas valve seat 11, itself defines a liquid valve seat 14 that is engageable by an upwardly biased concentric liquid valve 15. The gas valve 12 and the liquid valve 15 are closed when the keg is not tapped, and the top surfaces of these valves 12 and 15 and of the gas valve seat 11, which are then substantially coplanar, define the bottom of the well 10.

The annular gas valve 12 has a tubular stem portion 16 within which the liquid valve 15 is movable up and down. A downward extension 17 of this stem portion 16, which terminates near the bottom of the keg, comprises a siphon tube through which liquid can be brought up out of the keg to the picnic coupler 5. The liquid is forced up into the siphon tube 17 by pressure gas which can be introduced into the top of the keg when the gas valve 12 is open and which is usually present in the keg before it is tapped.

The picnic coupler 5 comprises, in general, a substantially annular outer body member 30, which provides for releasably locking the picnic coupler to a keg, and an inner body member 31, which serves to maintain the gas valve 12 and the liquid valve 15 unseated when the coupler is fully installed on a keg.

The coupler 5 is locked to the keg upon establishment of a bayonet connection between flanges 32 on the exterior of the outer body member 30, each extending partway around it, and more or less standard lugs 33 on the keg unit, projecting radially into the well 10 near the top thereof. The inner body member 31 has an upper portion of relatively large diameter that comprises a cylindrical upwardly opening pump chamber 34, and it has a coaxial, smaller diameter lower portion 35 that is surrounded by the outer body member 30 and is rotatable and axially slidable relative to it. There is a cam connection between the body members 30,31, comprising radially inwardly projecting cam follower lugs 36 on the outer body member 30, engaged in cam grooves 37 in the cylindrical surface of the inner body member 31 that extend circumferentially at a spiral inclination in one axial direction. By this cam connection, rotation of the inner body member 31 in one direction relative to the outer body member 30 is translated into downward motion of the inner body member 31 to a valve-unseating position, in which it is shown and wherein a probe portion 40 on its bottom holds open the gas valve 12 and the liquid valve 15. To prevent the escape of pressure gas, the clearance space between the body members 30 and 31 is sealed by means of an O-ring 79 that is confined under resilient compression between them.

The liquid that flows up past the liquid valve 15 from the siphon tube 17 enters a liquid passage 42 in the inner body member 31. The inlet 43 to this liquid passage 42 is in the probe portion 40 and is thus at the bottom of the inner body member 31 and concentric to it. The outlet end portion of the liquid passage 42, which can be threaded to receive a hose nipple 44, is in a large diameter intermediate portion of the inner body member 31, below the pump chamber 34 and above the outer body member 30, and it opens laterally to one side of that intermediate portion. A beverage hose 45 can have one of its ends connected to the nipple 44 and can have at its other end a suitable dispensing valve 46.

As more fully described in the above-identified copending application, a plunger 48 is manually reciprocable in the pump chamber 34 that comprises the upper portion of the inner body member 31, providing a pump whereby pressure air can be forced down through a gas passage 49 in the inner body member and thus past the open gas valve 12 of the keg unit and into the keg. The gas passage 49, which extends substantially vertically through the inner body member 31, opens to the bottom of that body member in laterally spaced relation to the inlet 43 of the liquid passage 42. At its upper end the gas passage 49 opens upwardly into the pump chamber 34. The upper portion of the gas passage 49 is of enlarged diameter to accommodate a duck-bill check valve 50 which permits downward flow of air but prevents upward flow.

The pump chamber 34 is preferably made as a cup-shaped plastic molding that is fastened to the metal part of the inner body member 31 by means of screws 53. A gasket 57 is preferably confined between the bottom wall 54 of the pump chamber part and the flat top surface of the metal part, to provide a gas seal at the registering holes in them that define the gas passage 49.

An annular collar-like cap member 58 fits over the rim of the pump chamber side wall 55, surrounding the plunger 48 with some clearance to guide the plunger in its reciprocating motion, and providing a closure for an annular space between said side wall 55 and the cylindrical body of the plunger. As fully described in the aforesaid copending application, the cap 58 is releasably locked to the inner body member 31 by means of a snap ring 63. As also described in that application, an O-ring 74 that surrounds the plunger 48 of the air pump functions both as a sliding seal for that plunger and as a check valve element that allows air to be drawn into the pump chamber 34 as the plunger moves up but prevents it from escaping as the plunger is depressed. The plunger 48 is biased upwardly by a coiled compression spring 70 in the pump chamber 34, and the cap 58 defines an upper limit of its motion.

Because the plunger 48 has a relatively large diameter and short stroke, and because it is biased upward, it can be very easily actuated with a flatwise motion of the palm of the hand. The large cross-section area of the plunger 48 ensures that when pressure in the keg is as high as necessary, there will be a substantial force on the plunger that resists its downward motion and discourages further pumping, so that overpressurization of the keg is very unlikely to occur.

In being resiliently compressed between the body members 30 and 31, the O-ring 79 serves as a connection through which a limited amount of torque can be transmitted from one to the other of them. There are lobe-like bulges 60 on the cap 58 which serve as finger grips that facilitate rotation of the picnic coupler 5 about its axis as it is being installed on or removed from a keg. Thus, by a rotational movement of the inner body member 31 in the appropriate direction, through less than half a turn, the bayonet connection 32, 33 between the keg and the outerbody member 30 can be established as the O-ring 79 constrains the outer body member to rotate with the inner one; and thereafter the slipping of the O-ring 79 enables the cam means 36, 37 to be effective in carrying the inner body member down to its valve unseating position. Removal of the picnic coupler from a keg is of course accomplished by a similar rotational movement of the inner body member 31, but in the opposite direction.

When the tapping coupler 5 is initially installed on a keg, as pointed out above, the pressure in the keg is likely to be excessive. To provide for relief of such keg pressure, the portable tapping unit has a vent passage 81 which opens outwardly from its gas passage 49 and which is controlled by a manually actuatable, normally closed vent valve 82. The vent passage 81 preferably extends radially outwardly from the gas passage 49 and is communicated with the gas passage at a zone thereof that is effectively below the level of the duckbill check valve 50 so that gas pressure in the vent passage always tends to be the same as that in the keg to which the coupler 5 is connected. The outlet of the vent passage 81, which is in the intermediate portion of the inner body member 31, below the pump chamber 34 and above the outer body member 30, is preferably diametrically opposite the nipple 44 that comprises the outlet from the liquid passage 42. A cylindrical push button actuator 83 of the vent valve 82, which is slidable in the outlet portion of the vent passage, projects a distance beyond the inner body member 31 to be readily accessible for manual actuation. However, because of its location at the side of the unit and below the pump chamber 34, the actuator 83 is not likely to be actuated inadvertently, and in this respect it will be observed that the actuator is located remotely from the pump plunger 48 as well as at a substantial distance from the finger-grip bulges 60 that are normally grasped when the unit is installed on a keg or removed therefrom.

As shown, the vent passage 81 is formed by a bore portion 84 which opens from the gas passage 49 and a larger diameter coaxial counterbore 85 which opens to the exterior of the body member 31 and which has an internally threaded outer end portion. A bushing 87, threaded into the outer end portion of the counterbore 85 and surrounded by an O-ring 88 that seals it to the body member 31, provides a reduced diameter outlet portion of the vent passage in which the actuator 83 is axially slidable. The inner end of the bushing 87 defines an inwardly facing annular valve seat 89 in the vent passage, engageable by an enlarged diameter inner end portion of the vent valve 82, comprising the valve element 90 proper. In this case the valve seat 89 is defined by an inwardly divergent frustoconical surface on the bushing 87 and the valve element 90 comprises an O-ring received in a shallow groove in the body of the vent valve 82.

The shoulder defined by the junction of the bore 84 and the counterbore 85 serves as a seat for a helical compression spring 91 that reacts against the vent valve 82 to bias it outwardly and maintain it normally seated. The cylindrical actuator or push button 83 of the vent valve has a rather loose sliding fit in the bushing 87 so that upon opening of the valve, pressure gas can escape through the clearance space between that actuator and the bushing.

It will be apparent that when the coupling unit 5 of this invention is installed on a beer keg to tap the same, pressing inward on the push button actuator for just a second or two will relieve gas pressure in the keg and prevent wild beer from being dispensed. Thereafter a few strokes of the hand pump plunger 48 will bring keg pressure to the right value for dispensing beer in very satisfactory condition. If by any chance the hand pump is used to excess, keg pressure can again be relieved by means of the push button vent valve 82.

From the foregoing description taken with the accompanying drawing it will be apparent that this invention provides a portable keg tapping coupler which is very compact and inexpensive, comprises an easily operated hand pump, and overcomes the problem of dispensing wild beer by reason of its having a very convenient vent valve whereby excessive keg pressure can be quickly relieved.

What is claimed is:

1. A portable keg tapping unit for a keg closure that has an annular gas valve seat at the bottom of an upwardly opening well and wherein an upwardly biased annular gas valve normally engages said gas valve seat and itself comprises a seat for a concentric upwardly biased liquid valve, said keg tapping unit comprising an outer body member receivable in said well and detachably connectable with said closure and an inner body member coaxially movable up and down relative to said outer body member to and from a lowered operative position in which said inner body member holds said gas valve and said liquid valve unseated for flow of pressure gas into the keg and flow of liquid out of the same, said keg tapping unit being characterized by:

A. said inner body member having (1) a lower portion received in the outer body member, (2) a substantially coaxial intermediate portion which is above the outer body member, and (3) an upper portion which comprises a pump chamber wherein a manually actuatable plunger is reciprocable up and down;

E. said inner body member having therein (1) a liquid passage which opens substantially concentrically to its bottom, (2) a gas passage which extends downwardly from said pump chamber and opens to its bottom in laterally spaced relation to said liquid passage, and (3) a vent passage which opens outwardly from said gas passage to one side of said intermediate portion and in which there is a coaxial inwardly facing annular vent valve seat defined by a reduced diameter outer end portion of said vent passage; and C. a push button valve in said vent passage (1) having an actuator portion which is axially slidable in said reduced diameter portion of the vent passage and which is accessible at the exterior of the inner body member and (2) having an enlarged diameter axially inner valve portion which is normally engaged with said vent valve seat but is disengageable therefrom for relief of excess keg pressure by inward manual actuation of said actuator.

2. The keg tapping unit of claim 1, further characterized by:

D. said vent passage being defined by (a) a bore in said intermediate portion opening radially outwardly from said gas passage to a coaxial larger diameter outwardly opening counterbore that has a threaded outer end portion, and (b) an externally threaded bushing received in the threaded portion of said counterbore and defining said reduced diameter outer end portion of the vent passage and said vent valve seat.

3. The keg tapping unit of claim 2, further characterized by:

a spring in said counterbore, engaged against an outwardly facing shoulder defined by the junction of said counterbore with said bore and reacting against said valve portion to urge the same into engagement with said vent valve seat.

4. A portable keg tapping unit comprising an outer body member that is detachably receivable in an upwardly opening well in a valved keg closure unit and an inner body member that is movable concentrically up and down relative to said outer body member, to and from a lowered position in which the inner body member holds concentric gas and liquid valves in a closure unit off of their seats to permit pressure gas to enter the keg and liquid to flow out of the same, said inner body member having a lower portion that is coaxially received in said outer body member and an outlet portion which projects above the outer body member, said portable tapping unit being characterized by:

A. said inner body member having thereon, above its outlet portion, a substantially coaxial pump chamber in which a plunger that is accessible at the top of the tapping unit is reciprocable up and down;

B. said inner body member having therein (1) a liquid passage which opens substantially concentrically to its bottom and laterally to one side of said outlet portion, through which liquid can flow out of a keg, (2) a gas passage opening downwardly to its bottom in laterally spaced relation to said liquid passage and opening upwardly into said pump chamber, and (3) a vent passage opening laterally from said gas passage to another side of the body and through whch excess pressure gas can be vented from a keg; and C. a vent valve in said vent passage which is biased to a normally closed position, blocking the vent passage, and which comprises an actuator that is accessible at the exterior of the outer body member for manual opening to relieve pressure in the keg.

* * * * *